US011562671B2

(12) United States Patent
Kim et al.

(10) Patent No.: US 11,562,671 B2
(45) Date of Patent: Jan. 24, 2023

(54) ELECTROLUMINESCENT DISPLAY DEVICE AND METHOD FOR DRIVING IHE SAME

(71) Applicant: LG DISPLAY CO., LTD., Seoul (KR)

(72) Inventors: Jung Hyeon Kim, Goyang-si (KR); Tae Wook Kim, Yongin-si (KR); Seok Hyun Hong, Gimpo-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/538,139

(22) Filed: Nov. 30, 2021

(65) Prior Publication Data

US 2022/0189355 A1 Jun. 16, 2022

(30) Foreign Application Priority Data

Dec. 15, 2020 (KR) ..... 10-2020-0175163

(51) Int. Cl.
*G09G 3/20* (2006.01)
*G09G 3/00* (2006.01)

(52) U.S. Cl.
CPC ..... *G09G 3/006* (2013.01); *G09G 3/20* (2013.01); *G09G 2320/045* (2013.01); *G09G 2330/12* (2013.01)

(58) Field of Classification Search
CPC .... G09G 3/006; G09G 3/20; G09G 2320/045; G09G 2330/12; G09G 2300/0842; G09G 3/3233; G09G 2320/0233; G09G 2320/0295
See application file for complete search history.

(56) References Cited

U.S. PATENT DOCUMENTS 5,479,606 A * 12/1995 Gray ..... G06F 11/321 714/E11.182
7,355,574 B1 * 4/2008 Leon ..... G09G 3/3233 345/82
2006/0077135 A1 * 4/2006 Cok ..... G09G 3/3225 345/76
2006/0077136 A1 * 4/2006 Cok ..... G09G 3/3216 345/76
2007/0171311 A1 * 7/2007 Chan ..... G09G 3/2092 345/83
2007/0262709 A1 * 11/2007 Cok ..... G09G 3/3208 313/506
2007/0266345 A1 * 11/2007 Cok ..... G09G 3/3225 345/101
2008/0272999 A1 * 11/2008 Kurokawa ..... G09G 3/3611 345/89

(Continued)

FOREIGN PATENT DOCUMENTS

KR 10-2014-0082498 A 7/2014
KR 10-2014-0091095 A 7/2014

*Primary Examiner* — Jose R Soto Lopez
(74) *Attorney, Agent, or Firm* — Polsinelli PC

(57) ABSTRACT

An electroluminescent display device includes a display panel including a plurality of pixels, a first compensation value calculator for calculating a first compensation value based on prediction according to an accumulation result of video data to be written in the pixels, a second compensation value calculator for calculating a second compensation value based on sensing according to an electrical sensing value with respect to driving characteristics of the pixels, and a data corrector for correcting the video data based on the first compensation value and the second compensation value.

15 Claims, 17 Drawing Sheets

(56) References Cited

U.S. PATENT DOCUMENTS

| | | | | |
|---|---|---|---|---|
| 2009/0201231 | A1* | 8/2009 | Takahara | G09G 3/3233 345/76 |
| 2012/0133835 | A1* | 5/2012 | Van Heesch | G09G 5/00 348/576 |
| 2014/0168186 | A1* | 6/2014 | Kang | G09G 3/3648 345/212 |
| 2016/0293102 | A1* | 10/2016 | Chaji | G09G 3/20 |
| 2019/0259325 | A1* | 8/2019 | Chaji | G06T 7/90 |
| 2020/0184887 | A1* | 6/2020 | Nien | G09G 3/3225 |
| 2021/0150950 | A1* | 5/2021 | Lin | G09G 3/3406 |

* cited by examiner

FIG. 10

| | Compensation value range | | | Count | Percentage | |
|---|---|---|---|---|---|---|
| Interval1 | 0 | ~ | 63 | 70 | 0.65 % | |
| Interval2 | 64 | ~ | 127 | 377 | 3.49 % | |
| Interval3 | 128 | ~ | 191 | 722 | 6.69 % | |
| Interval4 | 192 | ~ | 255 | 1375 | 12.73 % | |
| Interval5 | 256 | ~ | 319 | 1725 | 15.97 % | |
| Interval6 | 320 | ~ | 383 | 2904 | 26.89 % | |
| Interval7 | 384 | ~ | 447 | 1941 | 17.97 % | |
| Interval8 | 448 | ~ | 511 | 942 | 8.72 % | |
| Interval9 | 512 | ~ | 575 | 565 | 5.23 % | Higher interval |
| Interval10 | 576 | ~ | 639 | 152 | 1.41 % | |
| Interval11 | 640 | ~ | 703 | 26 | 0.24 % | |
| Interval12 | 704 | ~ | 767 | 1 | 0.01 % | |
| Interval13 | 768 | ~ | 831 | 0 | 0 % | |
| Interval14 | 832 | ~ | 895 | 0 | 0 % | |
| Interval15 | 896 | ~ | 959 | 0 | 0 % | |
| Interval16 | 960 | ~ | 1023 | 0 | 0 % | |

Total compensation value (Φ+TC) histogram (before shift)

Total compensation value (Φ+TC) histogram (after shift)

ELECTROLUMINESCENT DISPLAY DEVICE AND METHOD FOR DRIVING IHE SAME

CROSS-REFERENCE TO RELATED APPLICATION

This application claims the priority of Korean Patent Application No. 10-2020-0175163, filed on Dec. 15, 2020, which is hereby incorporated by reference in its entirety as if fully set forth herein.

BACKGROUND

Field of the Disclosure

The present disclosure relates to an electroluminescent display device and a method for driving the same.

Description of the Background

Electroluminescent display devices are divided into an inorganic light emitting display device and an organic light emitting display device according to a material of an emission layer. Each pixel of an electroluminescent display device includes a self-emissive light emitting element and adjusts luminance by controlling the amount of emission of the light emitting element according to a data voltage depending on grayscales of video data. Each pixel circuit may include a driving element.

Pixels may have different driving characteristics as driving time passes. When characteristic differences between pixels are generated, a pixel current contributing to emission becomes different in pixels even if the same data voltage is applied to the pixels. The pixel current differences cause luminance nonuniformity, deteriorating picture quality.

Although various attempts to compensate for driving characteristic differences between pixels in an electroluminescent display device are made, there are problems that compensation performance is low and various side effects are generated.

SUMMARY

Accordingly, the present disclosure is directed to an electroluminescent display device and a method for driving the same that substantially obviate one or more problems due to limitations and disadvantages of the related art.

The present disclosure is to provide an electroluminescent display device and a method for driving the same to improve compensation performance while minimizing side effects in compensation of driving characteristic differences between pixels.

To achieve these and other advantages and in accordance with the purpose of the disclosure, as embodied and broadly described herein, an electroluminescent display device includes a display panel including a plurality of pixels, a first compensation value calculator configured to calculate a first compensation value based on prediction according to an accumulation result of video data to be written in the pixels, a second compensation value calculator configured to calculate a second compensation value based on sensing according to an electrical sensing value with respect to driving characteristics of the pixels, and a data corrector configured to correct the video data on the basis of the first compensation value and the second compensation value, wherein, when a power on period and a power off period are alternatively repeated, video data of the pixels is accumulated in all power on periods and the driving characteristics of the pixels are sensed only in operation power off periods corresponding to some power off periods.

In another aspect of the present disclosure, a method for driving an electroluminescent display device includes calculating a first compensation value based on prediction according to an accumulation result of video data to be written in pixels, calculating a second compensation value based on sensing according to an electrical sensing value with respect to driving characteristics of the pixels, and correcting the video data on the basis of the first compensation value and the second compensation value, wherein, when a power on period and a power off period are alternately repeated, video data of the pixels is accumulated in all power on periods and the driving characteristics of the pixels are sensed only in operation power off periods corresponding to some power off periods.

BRIEF DESCRIPTION OF THE DRAWINGS

The accompanying drawings, which are included to provide a further understanding of the disclosure and are incorporated in and constitute a part of this application, illustrate aspect(s) of the disclosure and together with the description serve to explain the principle of the disclosure.

In the drawings:

FIG. 6 to FIG. 11 are diagrams for describing operation of the picture quality compensation circuit illustrated in FIG. 5;

DETAILED DESCRIPTION

Hereinafter, various aspects will be described in detail with reference to the attached drawings. The same reference numbers will be used throughout the drawings to refer to the same or like parts. In the following description, a detailed description of known functions and configurations incorporated herein will be omitted when it may obscure the subject matter of the present disclosure.

Figure 1:
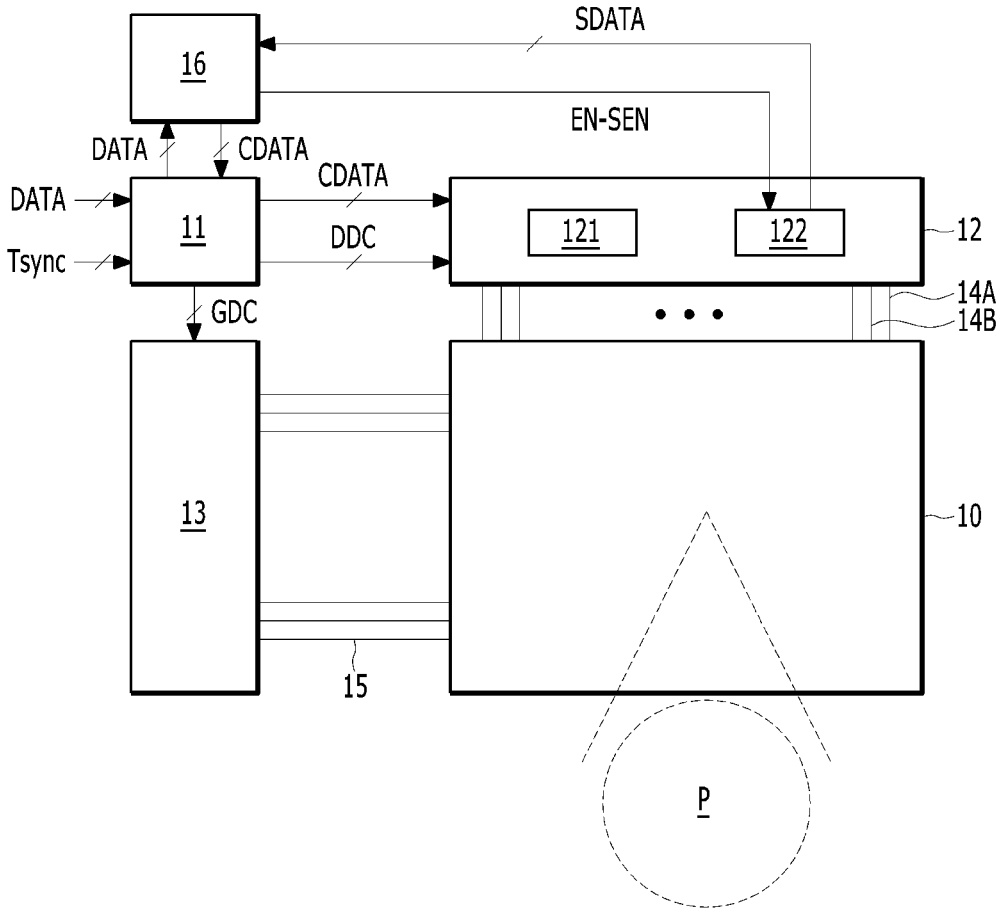
FIG. 1 is a block diagram illustrating an electroluminescent display device according to an aspect of the present disclosure.

FIG. 1 is a block diagram illustrating an electroluminescent display device according to an aspect of the present disclosure.

Referring to FIG. 1, the electroluminescent display device according to an aspect of the present disclosure may include a display panel 10, a timing controller 11, a data driver 12, a gate driver 13, and a picture quality compensation circuit 16. In FIG. 1, all or some of the timing controller 11, the data driver 12, and the picture quality compensation circuit 16 may be integrated into a drive integrated circuit.

Data lines 14A extending in a column direction (or vertical direction) intersect gate lines 15 extending in a row direction (or horizontal direction) and pixels P are arranged in a matrix at intersections to form a pixel array in an area in which an input image is displayed on the display panel 10. Each data line 14A is commonly connected to pixels P neighboring in the column direction and each gate line 15 is commonly connected to pixels P neighboring in the row direction. The pixel array further includes readout lines 14B connected to the pixels P.

The pixels P included in the pixel array may be grouped to express various colors. When a pixel group for color expression is defined as a unit pixel, one unit pixel may include red (R), green (G) and blue (B) pixels or red (R), green (G), blue (B) and white (W) pixels.

Each pixel P includes a light emitting element and a driving element that generates a pixel current according to a gate-source voltage and drives the light emitting element. The light emitting element may include an anode, a cathode, and an organic compound layer formed between the anode and the cathode. The organic compound layer may include a hole injection layer (HIL), a hole transport layer (HTL), an emission layer (EML), an electron transport layer (ETL), and an electron injection layer (EIL), but the present disclosure is not limited thereto. When a pixel current flows through the light emitting element, holes that have passed through the hole transport layer (HTL) and electrons that have passed through the electron transport layer (ETL) move to the emission layer (EML) to form excitons, and thus the emission layer (EML) can emit visible light. The organic compound layer may be replaced with an inorganic compound layer.

The driving element may be implemented as low-temperature polysilicon (LTPS) or an oxide thin film transistor based on a glass substrate (or plastic substrate), but the present disclosure is not limited thereto. The driving element may be implemented as a CMOS transistor based on a silicon wafer.

Attempts to implement some elements (particularly, a switching element having a source or a drain connected to a gate of a driving element) included in a pixel circuit as an oxide transistor are increasing. The oxide transistor uses an oxide, that is, IGZO, obtained by combining indium (In), gallium (Ga), zinc (Zn), and oxygen (O), instead of polysilicon, as a semiconductor material. The oxide transistor has the advantages that electron mobility is ten or more times that of an amorphous silicon transistor and manufacturing cost is considerably lower than that of the LTPS transistor. Further, the oxide transistor has high operation stability and reliability in a low-speed operation in which an off period of the transistor is relatively long because it has low off current. Accordingly, the oxide transistor may be employed for OLED TVs that require high definition and low-power operation or cannot obtain a screen size using a low-temperature polysilicon process.

Although all pixels need to have uniform electrical characteristics (e.g., a threshold voltage and electron mobility) of driving elements and uniform electrical characteristics (e.g., an operating point voltage or a threshold voltage) of light emitting elements, there may be electrical characteristic differences between pixels P due to stress with lapse of driving time (hereinafter referred to as driving characteristic deviations between pixels).

The picture equality compensation circuit 16 uses a hybrid compensation technique that is a combination of a real-time compensation technique based on data counting and an off compensation technique based on sensing. The real-time compensation technique is a technique of predicting a degree of deterioration of pixel elements (driving elements and/or light emitting elements) by accumulating video data DATA to be written in pixels during real-time operation (i.e., during a power on period) and deriving a first compensation value (hereinafter a real-time compensation value) for compensating for the deterioration. The off compensation technique is a technique of sensing driving characteristics of pixels P for a power off period and deriving a second compensation value (hereinafter an off compensation value) for compensating for pixel deterioration on the basis of a sensing result. The real-time compensation value and the off compensation value are derived per pixel. In the present disclosure, a power on period is defined as a real-time operation period in which the screen normally operates and a power off period is defined as a period from when the screen is turned off to when module power is off.

The picture quality compensation circuit 16 models relations between cumulative data and change in driving characteristics of pixels P and converts the cumulative data into a real-time compensation value through a modeling based look-up table. The picture quality compensation circuit 16 compensates for picture quality deterioration due to change in driving characteristics of pixels using a total compensation value obtained by adding an off compensation value to the real-time compensation value.

The off compensation technique is applied only in a power off period and thus change in driving characteristics of pixels P cannot be immediately compensated, whereas the hybrid compensation technique of the present disclosure can compensate for change in driving characteristics of pixels in real time as compared to the off compensation technique alone to delay a time at which unevenness of a screen is recognized. When only the real-time compensation technique based on predictive modeling is used, error may be generated between modeling values and actual driving characteristic change values as driving time increases, deteriorating compensation performance. To solve such a problem, the hybrid compensation technique of the present disclosure varies off compensation application timing according to a degree of distribution of real-time compensation values or total compensation values. The picture quality compensation circuit 16 generates corrected video data CDATA by applying the total compensation values to input video data DATA and provides the corrected video data CDATA to the timing controller 11.

The timing controller 11 receives a timing synchronization signal Tsync from a host system and generates timing control signals for controlling operation timing of the data driver 12 and the gate driver 13. The timing control signals may include a gate timing control signal GDC and a data timing control signal DDC. The timing controller 11 transmits the corrected video data CDATA generated in the picture quality compensation circuit 16 to the data driver 12 through an interface line.

The data driver 12 includes a data voltage generation circuit 121 and a sensing circuit 122.

The data voltage generation circuit 121 is connected to the pixels P through the data lines 14A. The data voltage generation circuit 121 generates a data voltage necessary to drive the pixels P and provides the data voltage to the data lines 14A in a power on period. The data voltage generation circuit 121 samples and latches the corrected video data CDATA received from the timing controller 11 on the basis of the data timing control signal DDC to convert the corrected video data CDATA into parallel data and converts the parallel data into analog data voltages according to gamma compensation voltages. The data voltage may be analog voltage values having different levels corresponding to grayscales of an image to be expressed by the pixels P. The data voltage generation circuit 121 may include a shift register, a latch, a level shifter, a digital-to-analog converter (DAC), and an output buffer.

The sensing circuit 122 is connected to the pixels P through the readout lines 14B. The sensing circuit 122 supplies a reference voltage necessary to drive the pixels P to the pixels P through the readout lines 14B in a power on period. The sensing circuit 122 senses a pixel current or a pixel voltage in which driving characteristics of the pixels P have been reflected to generate sensing result data SDATA in a power off period. The sensing circuit 122 transmits the sensing result data SDATA to the picture quality compensation circuit 16 through the interface line. The picture quality compensation circuit 16 analyzes the sensing result data SDATA, calculates a degree of actual change in the driving characteristics of the pixels P and calculates an off compensation value for compensating for the degree of change.

The gate driver 13 is connected to the pixels P through the gate lines 15. The gate driver 13 generates scan signals on the basis of the gate timing control signal GDC and supplies the scan signals to the gate lines 15 at data voltage supply timing. Horizontal pixel lines through which data voltages will be supplied are selected by the scan signals. Each scan signal may be generated as a pulse signal that swings between a gate on voltage and a gate off voltage. The gate on voltage is set to be higher than a threshold voltage of a transistor and the gate off voltage is set to be lower than the threshold voltage of the transistor. The transistor is turned on in response to the gate on voltage and turned off in response to the gate off voltage.

The gate driver 13 may be composed of a plurality of gate drive integrated circuits each including a gate shift register, a level shifter for converting an output signal of the gate shift register into a swing width suitable to drive transistors of the pixels, and an output buffer. Further, the gate driver 13 may be implemented in a gate in panel (GIP) structure and directly formed on the display panel 110. In the GIP structure, the level shifter may be mounted on a printed circuit board (PCB) and the gate shift register may be formed in a bezel area that is a non-display area of the display panel 10. The gate shift register includes a plurality of scan output stages connected in a cascading manner. The scan output stages are independently connected to the gate lines 15 to output scan signals to the gate lines 15.

Figure 2:
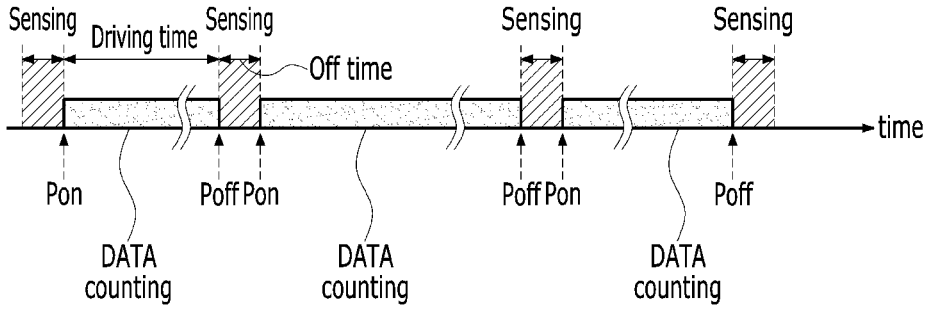
FIG. 2 and FIG. 3 are diagrams illustrating driving mechanisms according to a comparative example of the present disclosure.
Figure 3:
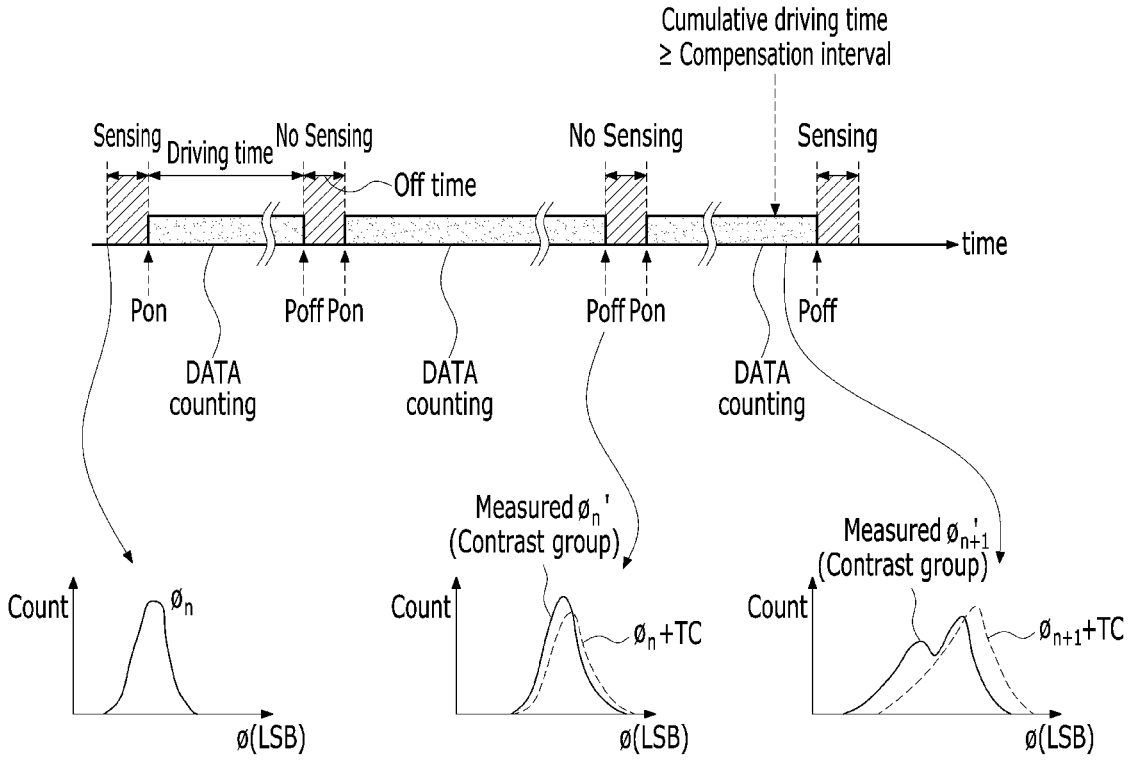

FIG. 2 and FIG. 3 shows driving mechanisms according to a comparative example of the present disclosure.

According to the hybrid compensation technique illustrated in FIG. 2, off compensation is performed in all power off periods, and thus a time necessary for sensing hinders user convenience and frequent update may reduce the lifespan of a memory.

According to the hybrid compensation technique illustrated in FIG. 3, only when cumulative driving time of a power on period (i.e., driving time) in which an operation of accumulating video data is performed becomes a compensation interval or longer, a sensing operation is performed in the following power off period to increase an off compensation interval and to reduce the number of times of off compensation. However, when a real-time compensation value is predicted on the basis of data counting in a power on period, error between a predicted modeling value and an actual pixel characteristic change value may be generated as driving time increases. In FIG. 3, Φn' and Φn+1' are a virtual measurement contrast group, TC is a real-time compensation value according to a predicted modeling value, and Φn is an off compensation value according to sensing. As can be ascertained from FIG. 3, when the off compensation interval excessively increases, total compensation values TC+Φn and TC+Φn+1 may not be consistent with measurement contrast group Φn' and Φn+1' and a degree of inconsistency increases as the off compensation interval increases.

Furthermore, according to the hybrid compensation technique illustrated in FIG. 3, when a total compensation value that has gradually increased according to real-time compensation values exceeds a gamma output permission range of a DAC, the total compensation value is saturated, causing compensation performance deterioration.

Figure 4:
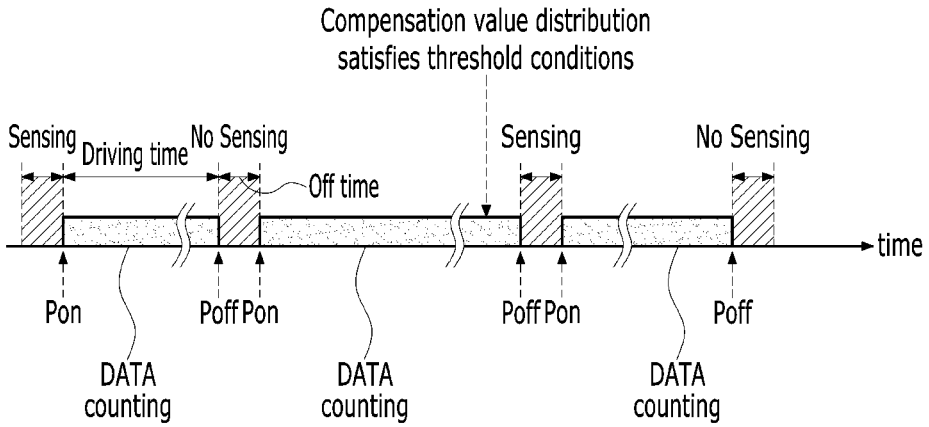
FIG. 4 is a diagram illustrating a driving mechanism according to an aspect of the present disclosure.

FIG. 4 shows a driving mechanism according to an aspect of the present disclosure.

Referring to FIG. 4, a hybrid compensation technique according to an aspect of the present disclosure supplements compensation errors that may be generated due to an off compensation interval that has increased when a data counting based real-time compensation value is applied. This hybrid compensation technique analyzes a distribution of real-time compensation values or total compensation values, and when distribution data satisfies preset threshold conditions, advances off compensation application timing to minimize compensation error and improve compensation performance.

When a power on period and a power off period are alternately repeated, the hybrid compensation technique of the present disclosure accumulates video data DATA in all power on periods in order to derive real-time compensation values and performs a sensing operation for deriving off compensation values only in some power off periods in which the threshold conditions are satisfied among all power off periods. Consequently, according to the present disclosure, off compensation timing can be aperiodically varied according to a degree of distribution of real-time compensation values.

Furthermore, the hybrid compensation technique according to an aspect of the present disclosure controls a range of a total compensation value such that the total compensation value that has gradually increased according to real-time compensation values does not exceed a gamma output permission range of a DAC to supplement compensation performance.

Figure 5:
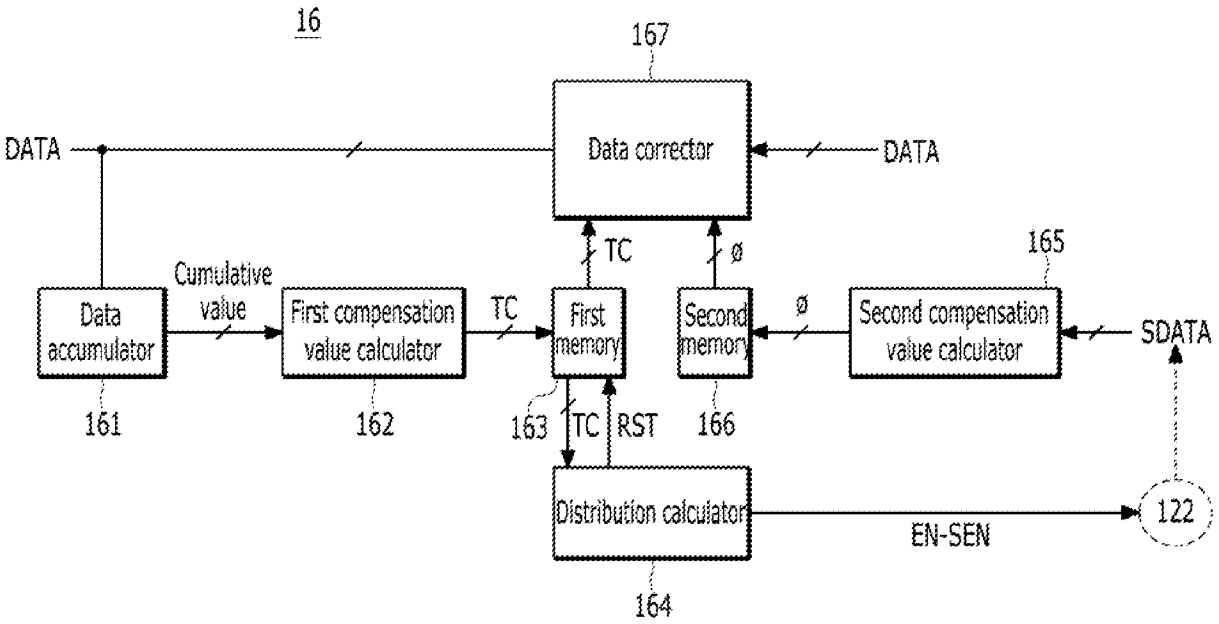
FIG. 5 is a diagram illustrating a configuration of a picture quality compensation circuit for realizing the driving mechanism of FIG. 4.

FIG. 5 is a diagram illustrating a configuration of the picture quality compensation circuit 16 for realizing the driving mechanism of FIG. 4 and FIG. 6 to FIG. 11 are diagrams for describing operation of the picture quality compensation circuit 16 illustrated in FIG. 5.

Referring to FIG. 5, the picture quality compensation circuit 16 includes a data accumulator 161, a first compensation value calculator 162, a first memory 163, a distribution calculator 164, a second compensation value calculator 165, a second memory 166, and a data corrector 167.

Figure 6:
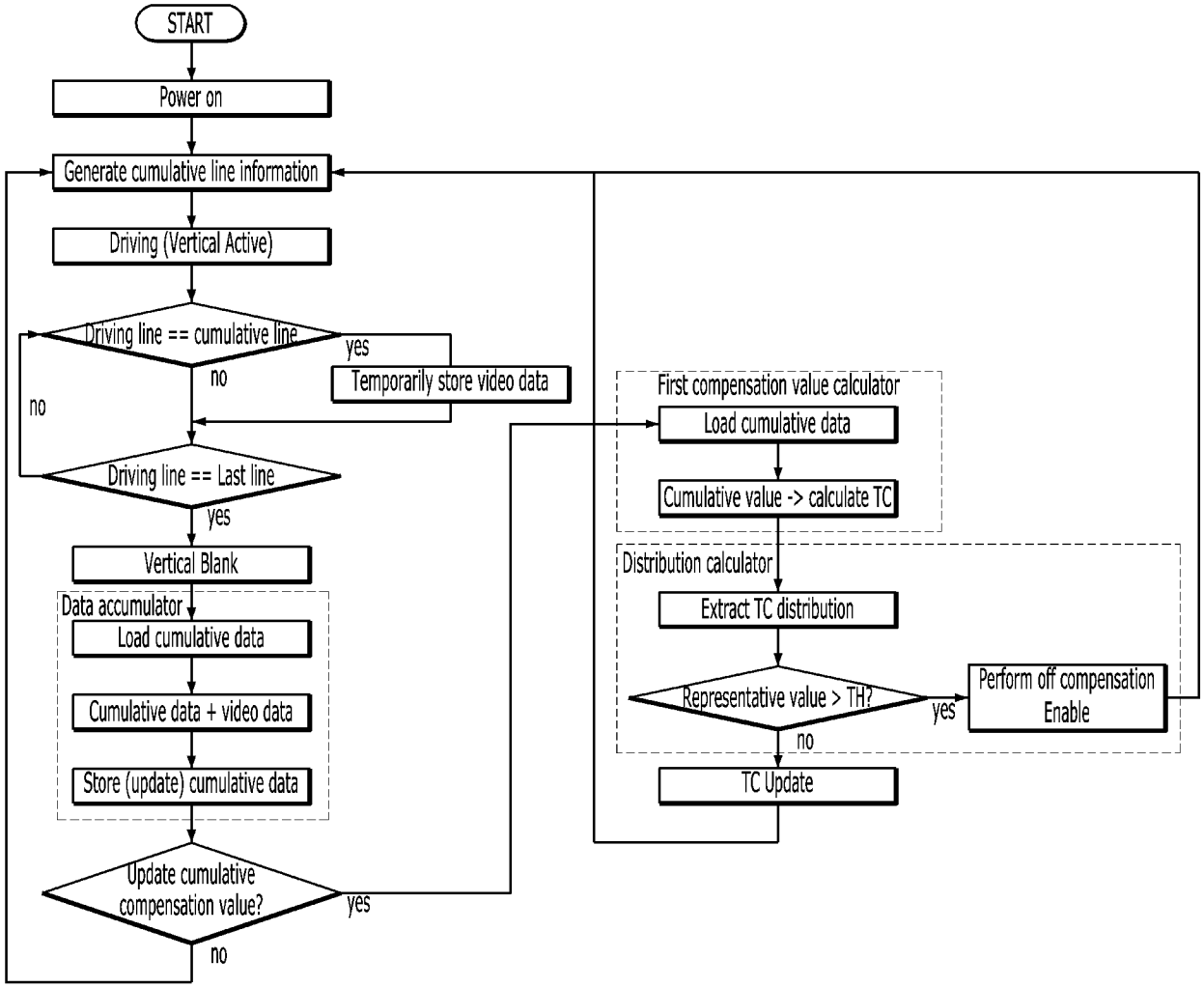

The data accumulator 161 accumulates corrected video data CDATA in a vertical blank period included in a power on period to output cumulative data as illustrated in FIG. 6. A power on period is composed of a plurality of frames and each frame includes a vertical active period in which the corrected video data CDATA is written in pixels and a vertical blank period in which writing of the corrected video data CDATA stops.

The first compensation value calculator 162 loads the cumulative data and calculates a real-time compensation value TC based on prediction according to the accumulation result of the cumulative data. The first compensation value calculator 162 models relations between the cumulative data and change in driving characteristics of pixels P and converts the cumulative data into the real-time compensation value TC through a prediction modeling based look-up table.

The first memory 163 stores the real-time compensation value TC in an update manner.

The second compensation value calculator 165 calculates an off compensation value Φ based on sensing according to an electrical sensing value SDATA with respect to the driving characteristics of the pixels.

The second memory 166 stores the off compensation value Φ in an update manner.

The data corrector 167 corrects video data DATA on the basis of a total compensation value TC+Φ corresponding to the sum of the real-time compensation value TC and the off compensation value Φ and outputs corrected video data CDATA according to the correction result.

The distribution calculator 164 aperiodically controls off compensation timing according to a degree of distribution of real-time compensation values TC. The driving characteristics of the pixels can be sensed only in some power off periods (hereinafter referred to as operation power off periods) among all power off periods according to the aperiodic off compensation timing.

Figure 7:
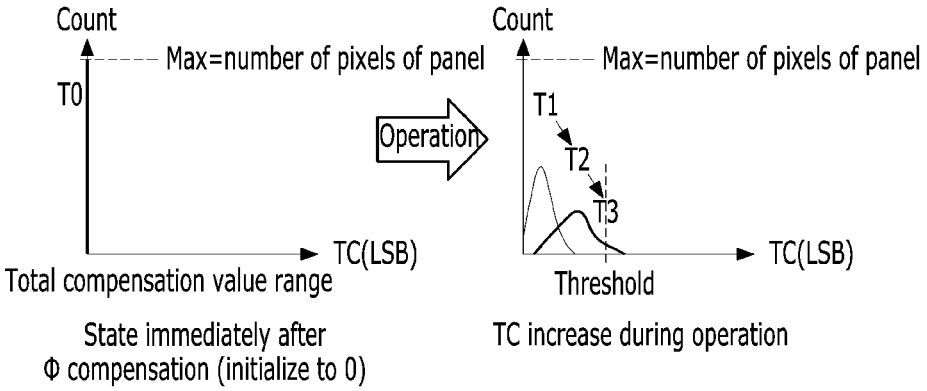

The distribution calculator 164 reads real-time compensation values TC stored in the first memory 163. The distribution calculator 164 histograms first distribution data by counting the real-time compensation values TC for a plurality of preset data intervals, and when a representative value of the first distribution data satisfies preset threshold conditions, stops update of the real-time compensation value TC, generates a sensing enable signal EN-SEN and transmits the sensing enable signal EN-SEN to the sensing circuit 122. Operations of the sensing circuit 122 and the second compensation value calculator 165 are enabled in the operation power off period according to the sensing enable signal EN-SEN. Further, when the off compensation value Φ is updated by the second compensation value calculator 165 in the operation power off period, the distribution calculator 164 generates a reset signal RST to initialize real-time compensation value information stored in the first memory 163. Accordingly, the real-time compensation value TC that has increased in a power on period before the operation power off period is initialized to 0, as illustrated in FIG. 7. The initialized real-time compensation value TC increases again according to a compensation value update operation in a power on period following the operation power off period.

Figure 8:
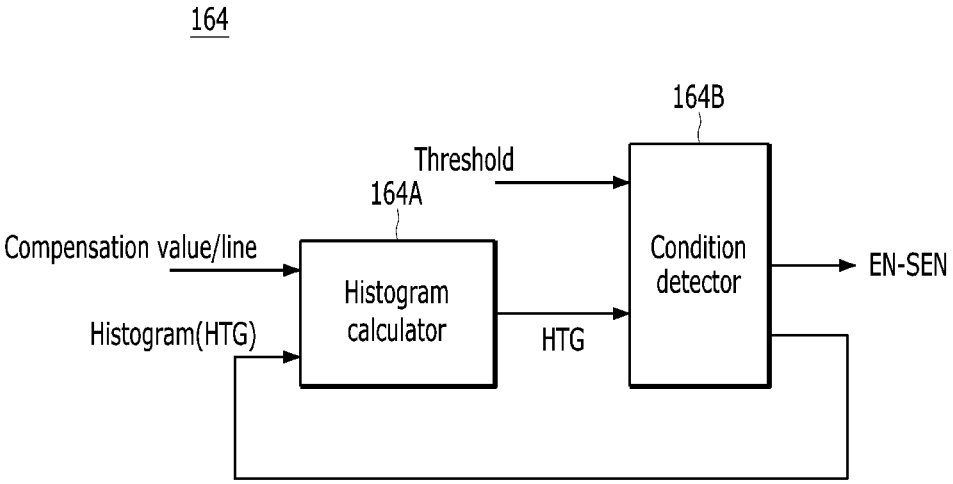
Figure 9:
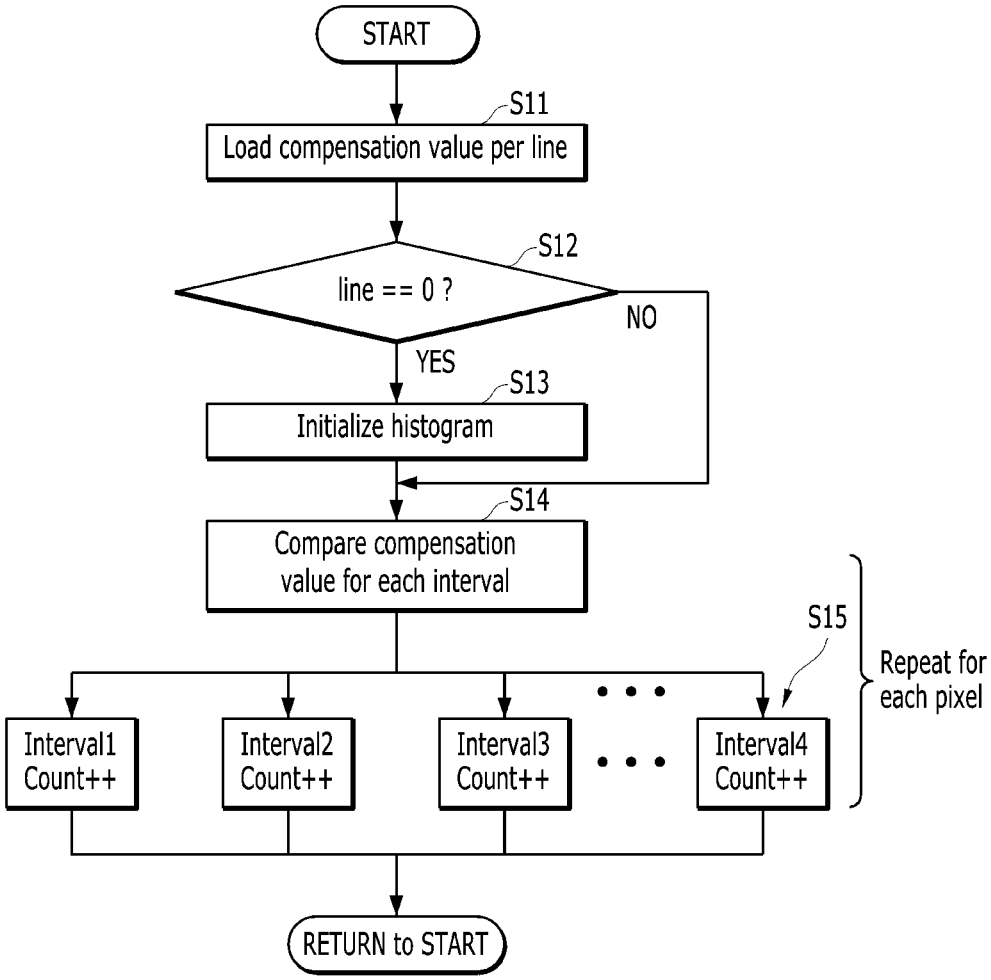

The distribution calculator 164 includes a histogram calculator 164A and a condition detector 164B as illustrated in FIG. 8. The histogram calculator 164A counts real-time compensation values TC loaded per line from the first memory 163 for a plurality of data intervals and generates a histogram having counts for data intervals of all line compensation values as first distribution data. Since a data interval is provided to determine whether off compensation conditions are satisfied, it can be set such that it can be confirmed and may be set to a single value or multiple values.

The condition detector 164B checks whether a representative value of the first distribution data satisfies preset threshold conditions, if the representative value of the first distribution data exceeds a threshold value, stops update of the real-time compensation value TC and outputs the sensing enable signal EN-SET for off compensation.

Here, the representative value of the first distribution data may include at least one of the sum of counts for predesignated higher data intervals, a maximum value among real-time compensation values corresponding to counts of 1 or more, an average of the real-time compensation values corresponding to counts of 1 or more, a mode of the real-time compensation values corresponding to counts of 1 or more, and a median of the real-time compensation values corresponding to counts or 1 or more.

Figure 11:
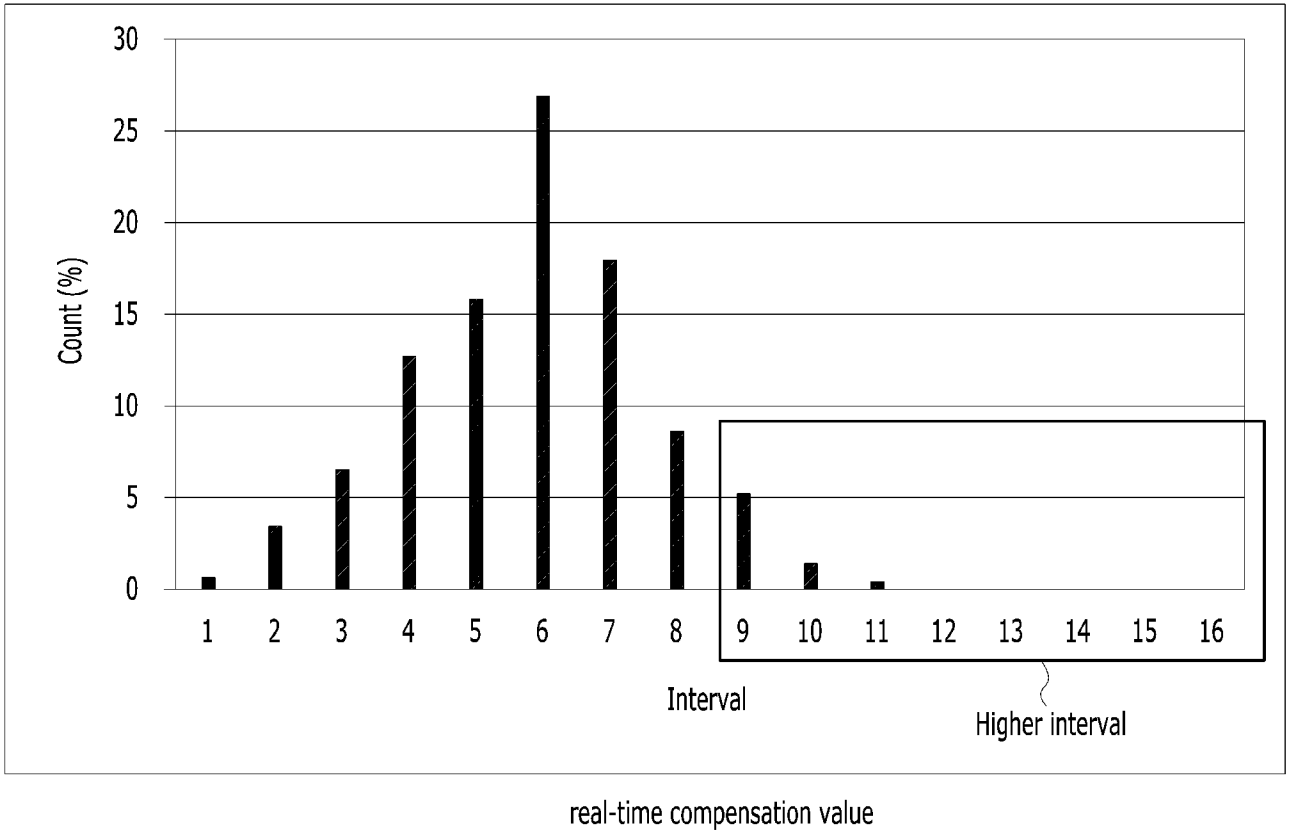

For example, when intervals 9 to 16 are set to higher data intervals, as illustrated in FIG. 10 and FIG. 11, the condition detector 164B may compare the sum (744) of counts of intervals 9 to 16 with a threshold value and output the sensing enable signal EN-SEN for off compensation if threshold conditions are satisfied as a comparison result. In FIG. 10 and FIG. 11, a maximum value of real-time compensation values corresponding to counts of 1 or more falls in a range of 704 to 767 of interval 12, and the condition detector 164B can output the sensing enable signal EN-SEN for off compensation if 704, which is the smallest value in the range of 704 to 767, satisfies the threshold conditions. In FIG. 10 and FIG. 11, an average of real-time compensation values corresponding to counts of 1 or more is 338.25, and the condition detector 164B can output the sensing enable signal EN-SEN for off compensation if 338.25 satisfies the threshold conditions.

Figure 12:
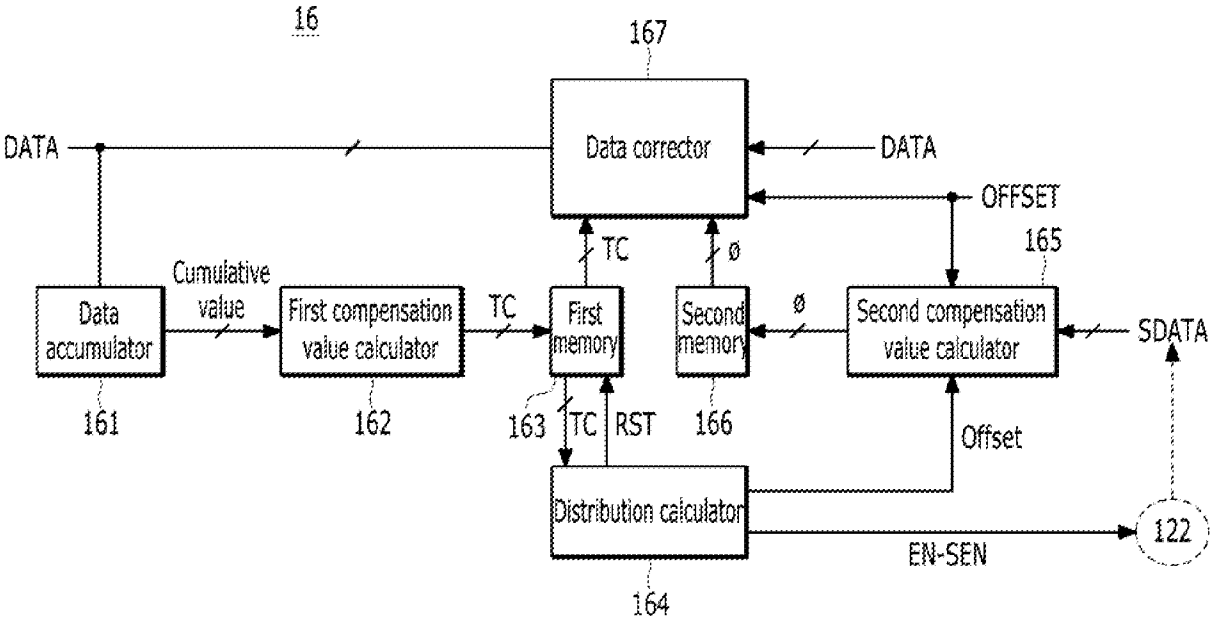
FIG. 12 is a diagram illustrating another configuration of the picture quality compensation circuit for realizing the driving mechanism of FIG. 4.

FIG. 12 is a diagram illustrating another configuration of the picture quality compensation circuit 16 for realizing the driving mechanism of FIG. 4 and FIG. 13 to FIG. 16B are diagrams for describing operation of the picture quality compensation circuit illustrated in FIG. 12.

Referring to FIG. 12, the picture quality compensation circuit 16 includes the data accumulator 161, the first compensation value calculator 162, the first memory 163, the distribution calculator 164, the second compensation value calculator 165, the second memory 166, and the data corrector 167.

Figure 13:
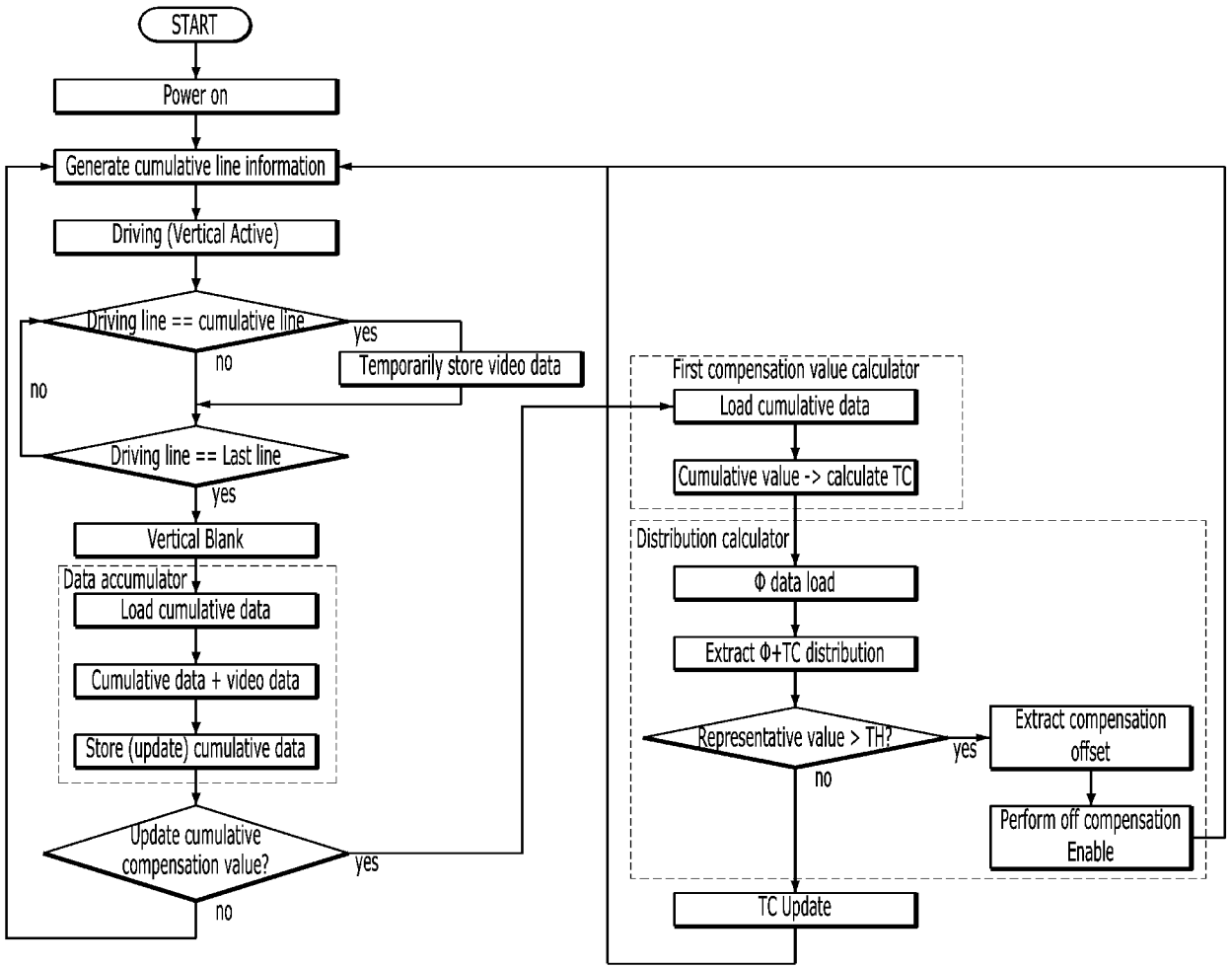
FIGS. 13, 14A-14C, 15 and 16A-16B are diagrams for describing operation of the picture quality compensation circuit illustrated in FIG. 12.

The data accumulator 161 accumulates corrected video data CDATA in a vertical blank period included in a power on period to output cumulative data as illustrated in FIG. 13.

The first compensation value calculator 162 loads the cumulative data and calculates a real-time compensation value TC based on prediction according to the accumulation result of the cumulative data, as illustrated in FIG. 13. The first compensation value calculator 162 models relations between the cumulative data and change in driving characteristics of pixels P and converts the cumulative data into a real-time compensation value TC through a prediction modeling based look-up table.

The first memory 163 stores the real-time compensation value TC in an update manner.

The second compensation value calculator 165 calculates an off compensation value Φ based on sensing according to an electrical sensing value SDATA with respect to the driving characteristics of the pixels.

The second memory 166 stores the off compensation value 0 in an update manner.

The data corrector 167 corrects video data DATA on the basis of a total compensation value TC+Φ corresponding to the sum of the real-time compensation value TC and the off compensation value Φ and outputs corrected video data CDATA according to the correction result.

The distribution calculator 164 aperiodically controls off compensation timing according to a degree of distribution of total compensation values TC+Φ. The driving characteristics of the pixels can be sensed only in some power off periods (hereinafter referred to as operation power off periods) among all power off periods according to the aperiodic off compensation timing.

The distribution calculator 164 reads real-time compensation values TC stored in the first memory 163 and off compensation values Φ stored in the second memory 166. The distribution calculator 164 histograms second distribution data by counting total compensation values Φ+TC corresponding to the sums of the real-time compensation values TC and the off compensation values Φ for a plurality of preset data intervals, and when a representative value of the second distribution data satisfies preset threshold conditions, stops update of the real-time compensation value TC, generates a sensing enable signal EN-SEN and transmits the sensing enable signal EN-SEN to the sensing circuit 122. Operations of the sensing circuit 122 and the second compensation value calculator 165 are enabled in the operation power off period according to the sensing enable signal EN-SEN. Further, when the off compensation value Φ is updated by the second compensation value calculator 165 in the operation power off period, the distribution calculator 164 generates a reset signal RST to initialize real-time compensation value information stored in the first memory 163. Accordingly, the real-time compensation value TC that has increased in a power on period before the operation power off period is initialized to 0. The initialized real-time compensation value TC increases again according to a compensation value update operation in a power on period following the operation power off period.

The distribution calculator 164 includes the histogram calculator 164A and the condition detector 164B as illustrated in FIG. 8. The histogram calculator 164A counts total compensation values Φ+TC per line for a plurality of data intervals and generates a histogram having counts for data intervals of all line compensation values as second distribution data. Since a data interval is provided to derive whether off compensation conditions are satisfied, it can be set such that it can be confirmed and may be set to a single value or multiple values.

The condition detector 164B checks whether a representative value of the second distribution data satisfies preset threshold conditions, if the representative value of the second distribution data exceeds a threshold value, stops update of the real-time compensation value TC and outputs the sensing enable signal EN-SET for off compensation.

Here, the representative value of the second distribution data may include at least one of the sum of counts for predesignated higher data intervals, a maximum value among real-time compensation values corresponding to counts of 1 or more, an average of the real-time compensation values corresponding to counts of 1 or more, a mode of the real-time compensation values corresponding to counts of 1 or more, and a median of the real-time compensation values corresponding to counts or 1 or more.

Particularly, the condition detector 164B may provide a preset negative (−) offset to the second compensation value calculator 165 in the operation power off period when the representative value of the second distribution data exceeds the threshold value. Then, the second compensation value calculator 165 can secure a sufficient compensation range within the gamma output permission range of the DAC by additionally applying the negative offset when the off compensation value Φ is calculated in the operation power off period. In this manner, the picture quality compensation circuit 16 secures a compensation voltage range by reflecting the negative offset in the off compensation value Φ extracted in the operation power off period to improve compensation performance upon determining that the total compensation value Φ+TC is likely to exceed the compensation voltage range.

Figure 14A:
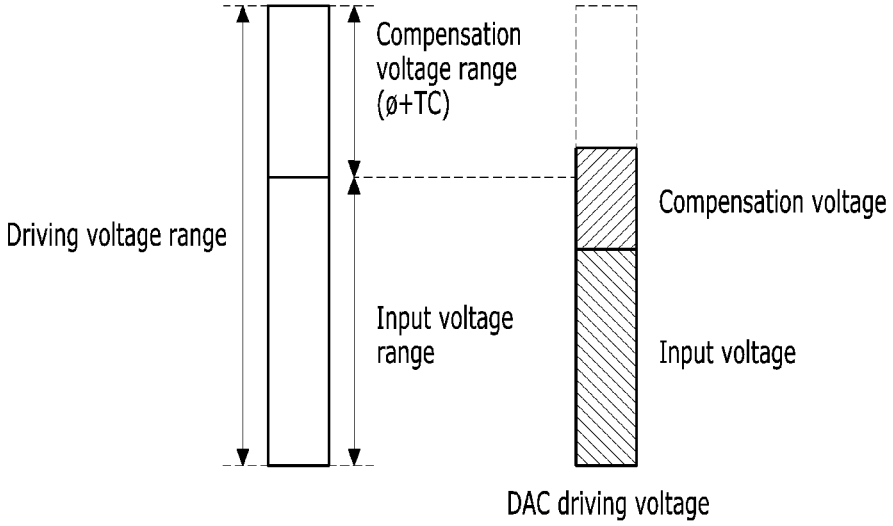

The gamma output permission range of the DAC is a driving voltage range of FIG. 14A. The driving voltage range is divided into an input voltage range and a compensation voltage range. The input voltage range is a voltage range corresponding to video data. The compensation voltage range is a voltage range corresponding to total compensation data. A voltage value that can be checked through the DAC is a total driving voltage corresponding to the sum of an input voltage and a compensation voltage.

Figure 14B:
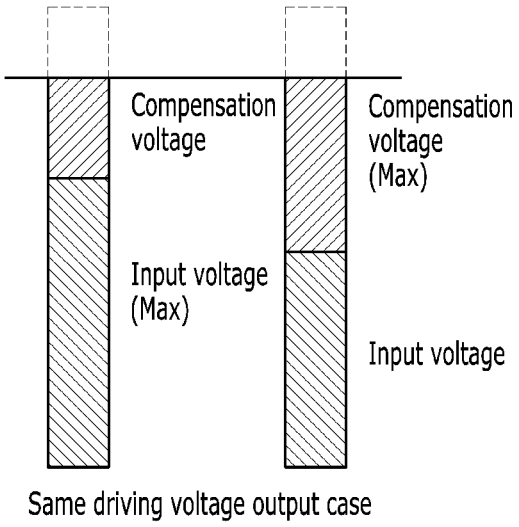
Figure 14C:
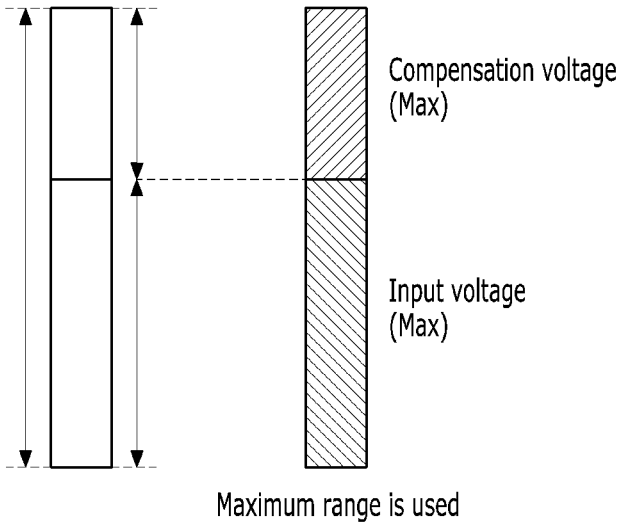

The negative offset is used when a compensation voltage of the full compensation voltage range is used. It is difficult to check a maximized compensation voltage as shown in FIG. 14B using a total driving voltage corresponding to the sum of an input voltage and a compensation voltage. Accordingly, to check whether a compensation voltage is maximized, it is possible to check whether a total driving voltage is output as a maximum value in a state in which a specific pattern in which an input voltage is maximized is applied, as shown in FIG. 14C, in the present disclosure. When the total driving voltage is output as the maximum value in the aforementioned state, a compensation voltage is also maximized.

Figure 15:
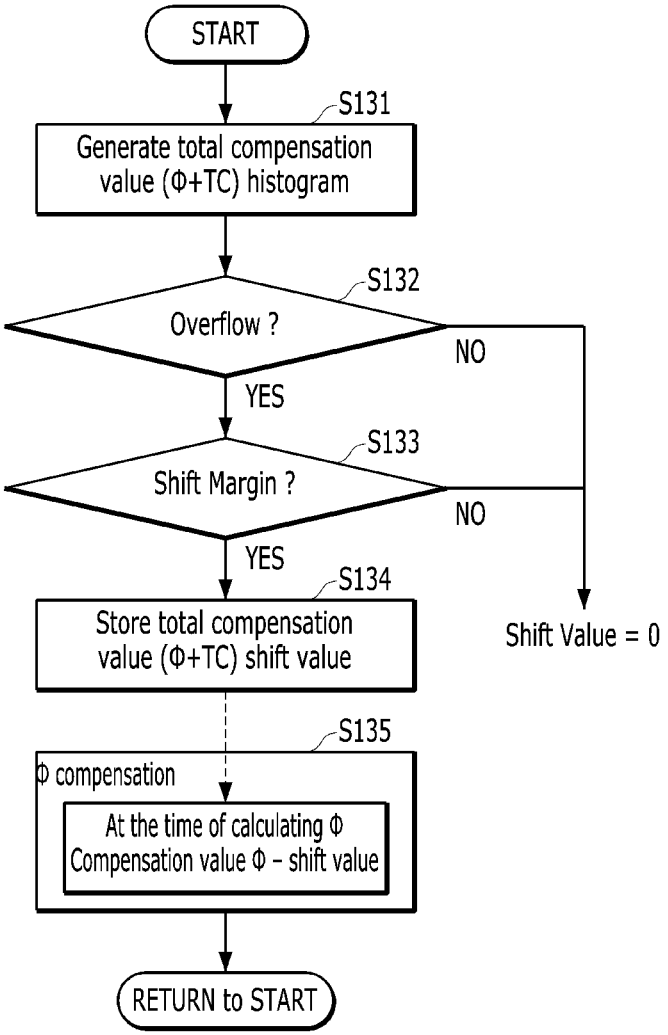
Figure 16A:
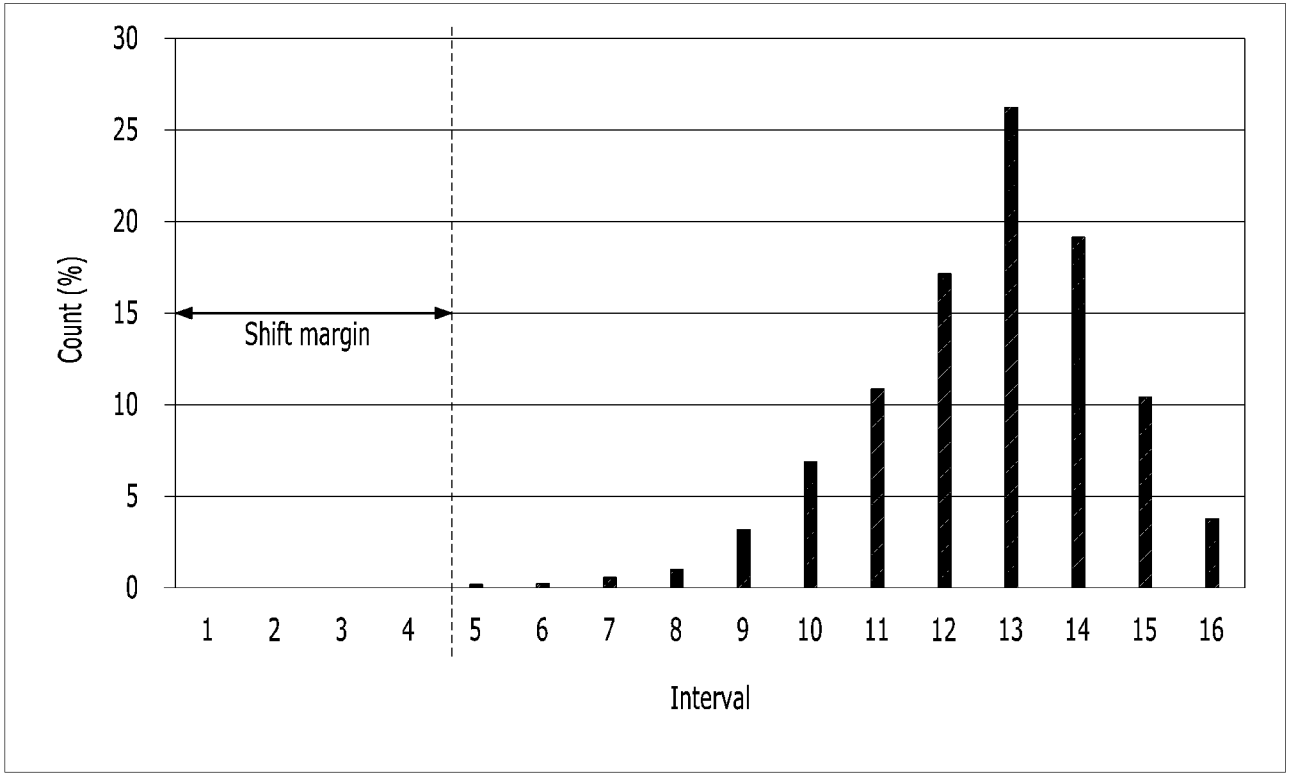
Figure 16B:
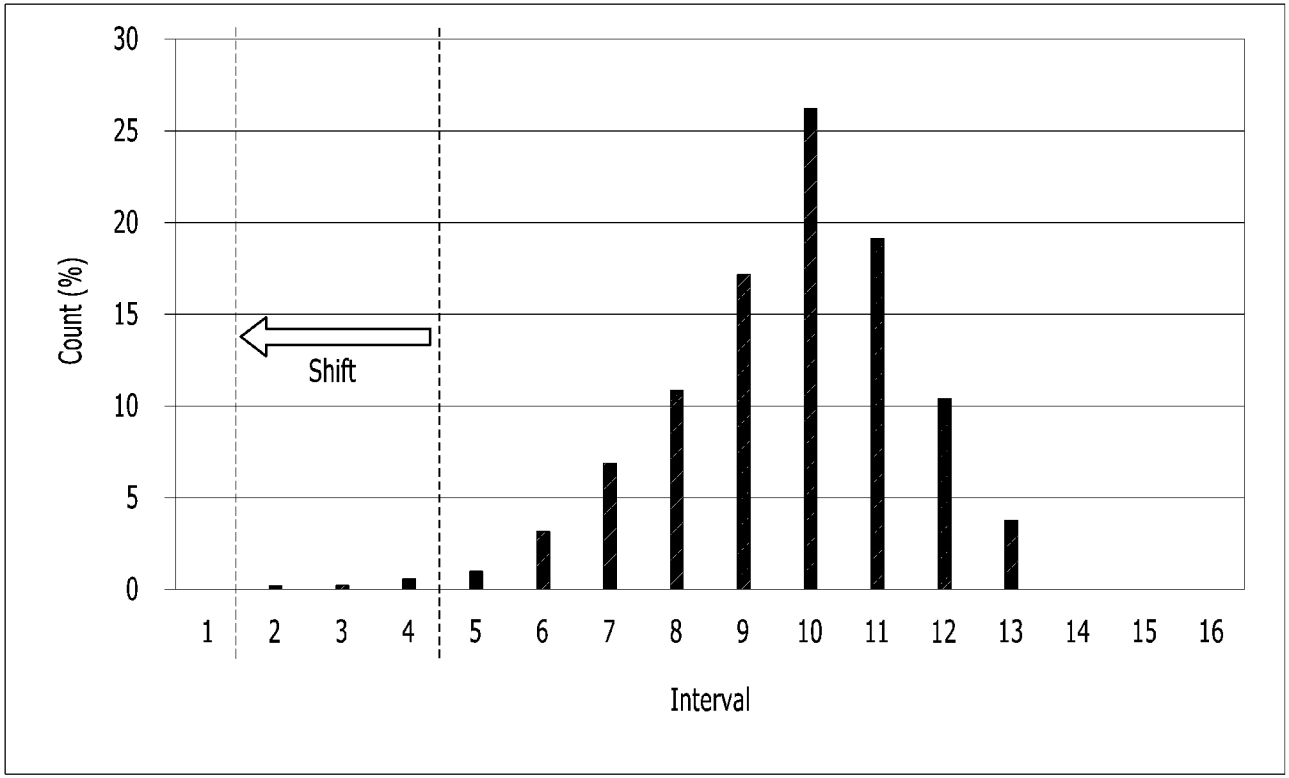

When the total compensation value Φ+TC exceeds a preset compensation threshold value, as shown in FIG. 15, the distribution calculator 164 increases a first voltage allocation range for the total compensation value Φ+TC and reduces the total compensation value Φ+TC through a shift margin within the predetermined gamma output permission range (shown in FIG. 16A and FIG. 16B).

Specifically, the distribution calculator 164 checks distribution of the total compensation value TC+Φ, and when overflow conditions are satisfied, controls a compensation voltage range to adjust a compensation value. To check whether overflow occurs, the distribution calculator 164 may compare the representative value of the second distribution data with a threshold value.

The distribution calculator 164 checks presence or absence of a voltage margin within the gamma output permission range prior to execution of the shift margin within the gamma output permission range. To this end, the distribution calculator 164 may check presence or absence of the voltage margin and derive a shiftable value using the sum of counts for predesignated lower data intervals in the second distribution data, a minimum value of real-time compensation values corresponding to counts of 1 or more, and the like.

The distribution calculator 164 increases the compensation voltage allocation range through data interval shifting for the histogrammed second distribution data. The distribution calculator 164 stores a shift value of the total compensation value TC+Φ. The shift value of the total compensation value TC+Φ may be additionally applied when the off compensation value Φ is calculated. The picture quality compensation circuit 16 secures the compensation voltage range using the shift value extracted in an operation power off period to improve compensation performance.

The picture quality compensation circuit 16 can decrease the reference voltage necessary to drive pixels by reduction in the total compensation value Φ+TC according to the shift margin to maintain the same gate-source voltage in driving TFTs of the pixels as compared to a case in which shifting is not performed.

Furthermore, the picture quality compensation circuit 16 can decrease an input voltage allocation range corresponding to video data by increase in the compensation voltage allocation range according to the shift margin within the gamma output permission range to cause the total driving voltage to satisfy the gamma output permission range.

Figure 17:
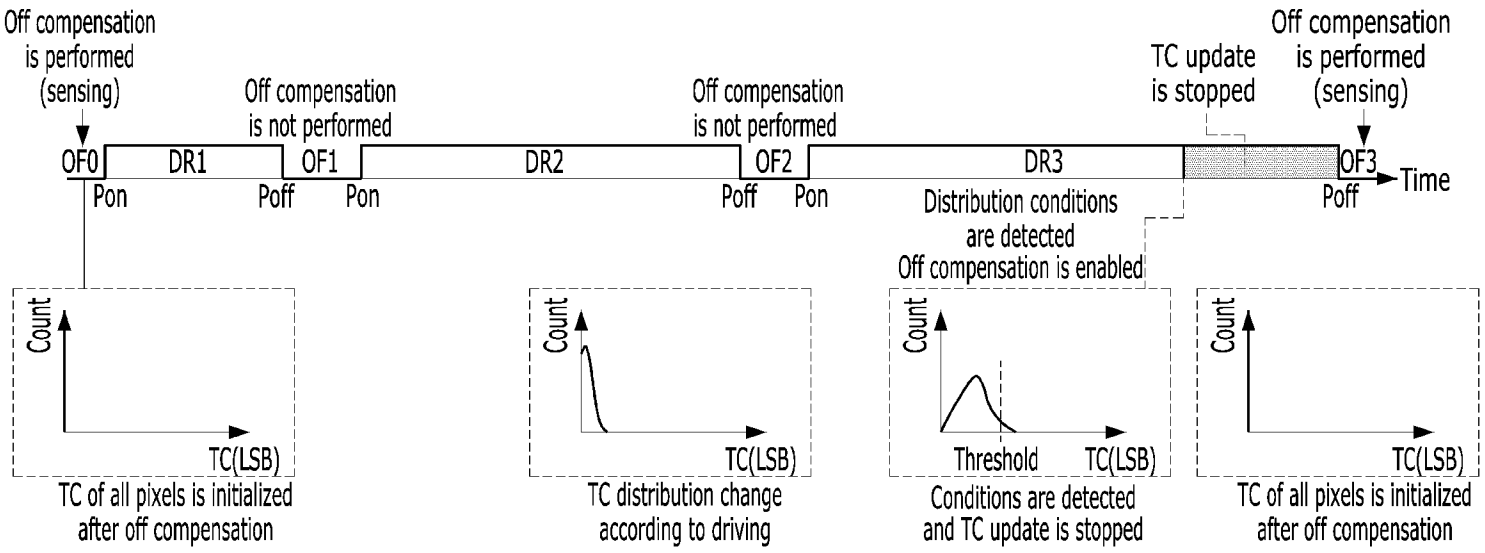
FIG. 17 and FIG. 18 are diagrams showing determination of off compensation intervals according to distribution of off compensation values according to an aspect of the present disclosure.
Figure 18:
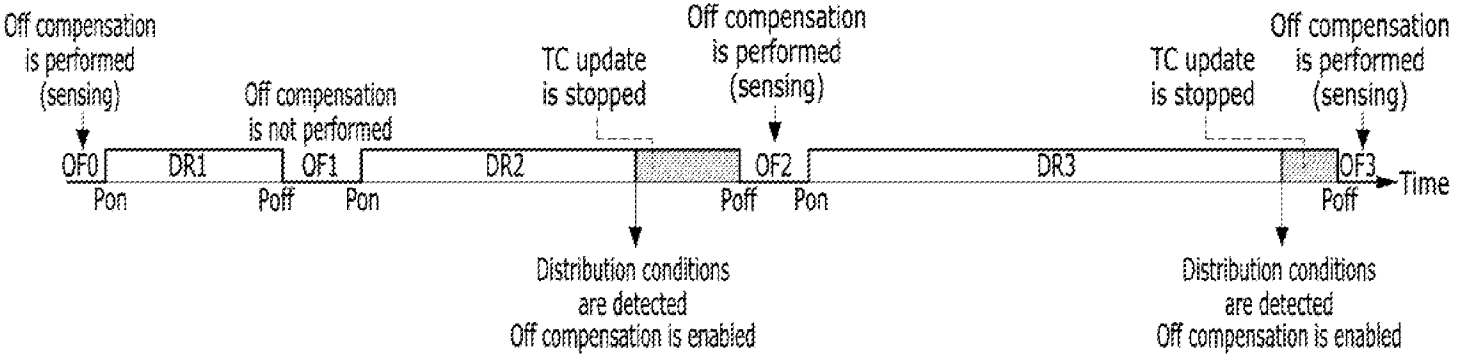

FIG. 17 and FIG. 18 are diagrams showing determination of off compensation intervals according to distribution of off compensation values according to an aspect of the present disclosure. In FIG. 17 and FIG. 18, DR1 to DR3 are power on periods in which an image is displayed and OF0 to OF3 are power off periods. Some of the power off periods OF0 to OF3 are operation power off periods in which sensing based off compensation is performed. The operation power off periods are OF0 and OF3 at FIG. 17. The operation power off periods are OF0, OF2 and OF3 at FIG. 18.

Referring to FIG. 17 and FIG. 18, it can be ascertained that a time interval between two neighboring operation power off periods (periods in which off compensation is performed), that is, an off compensation interval, varies according to grayscales of video data.

FIG. 17 shows off compensation intervals when a low-luminance image is displayed and FIG. 18 shows off compensation intervals when a high-luminance image is displayed. A time interval between two neighboring operation power off periods OF0 and OF3 shown in FIG. 17 is longer than a time interval between two neighboring operation power off periods OF0 and OF2 shown in FIG. 18. Accordingly, it can be ascertained that a time interval between two neighboring operation power off periods is shorter when a high-luminance image is displayed than when a low-luminance image is displayed.

It will be apparent to those skilled in the art that various modifications and variations can be made in the present disclosure without departing from the spirit or scope of the disclosures. Thus, it is intended that the present disclosure cover the modifications and variations of this disclosure provided they come within the scope of the appended claims and their equivalents.

The present disclosure has the following advantages.

It is possible to improve compensation performance while minimizing side effects in compensation of driving characteristic deviation between pixels.

The present disclosure supplements compensation error that may be generated due to an off compensation interval that has increased at the time of applying a data counting based real-time compensation value.

The present disclosure analyzes a distribution of real-time compensation values or total compensation values, and if distribution data satisfies preset threshold conditions, advances off compensation application timing to minimize compensation error and improve compensation performance.

The present disclosure controls a total compensation value range such that a total compensation value that has gradually increased according to a real-time compensation value does not exceed a gamma output permission range of DAC to improve compensation performance.

Effects which may be obtained by the present disclosure are not limited to the above-described effects, and various other effects may be evidently understood by those skilled in the art to which the present disclosure pertains from the following description.

What is claimed is:

1. An electroluminescent display device, comprising:

a display panel including a plurality of pixels;

a first compensation value calculator configured to calculate a first compensation value based on prediction according to an accumulation result of video data to be written in the pixels;

a second compensation value calculator configured to calculate a second compensation value based on sensing according to an electrical sensing value with respect to driving characteristics of the plurality of pixels; and a data corrector configured to correct the video data on based on the first compensation value and the second compensation value, wherein, when a power on period and a power off period are alternatively repeated, the video data of the plurality of pixels are accumulated in all power on periods and the driving characteristics of the plurality of pixels are sensed only in operation power off periods that are part of power off periods, and wherein a time interval between two neighboring operation power off periods changes according to grayscales of the video data.

2. The electroluminescent display device according to claim 1, wherein the first compensation value is initialized to "0" in the operation power off periods.

3. The electroluminescent display device according to claim 1, wherein the time interval between two neighboring operation power off periods is shorter when a high-luminance image is displayed on the display panel than when a low-luminance image is displayed on the display panel.

4. The electroluminescent display device according to claim 1, further comprising:

a first memory in which the first compensation value is updated;

a second memory in which the second compensation value is updated;

a sensing circuit configured to sense the driving characteristics of the pixels; and a distribution calculator configured to count the first compensation value for a plurality of preset data intervals to histogram first distribution data and, when a representative value of the first distribution data satisfies preset threshold conditions, to enable operations of the sensing circuit and the second compensation value calculator in the operation power off periods after stopping update of the first compensation value.

5. The electroluminescent display device according to claim 4, wherein the representative value of the first distribution data includes at least one of a sum of counts for predesignated higher data intervals, a maximum value among real-time compensation values corresponding to counts of 1 or more, an average of the real-time compensation values corresponding to counts of 1 or more, a mode of the real-time compensation values corresponding to counts of 1 or more, and a median of the real-time compensation values corresponding to counts or 1 or more.

6. The electroluminescent display device according to claim 1, further comprising:

a first memory in which the first compensation value is updated;

a second memory in which the second compensation value is updated;

a sensing circuit configured to sense the driving characteristics of the pixels; and a distribution calculator configured:

to count a total compensation value corresponding to a sum of the first compensation value and the second compensation value for a plurality of preset data intervals to histogram second distribution data, and to enable operations of the sensing circuit and the second compensation value calculator in the operation power off periods after stopping update of the first compensation value when a representative value of the second distribution data satisfies preset threshold conditions.

7. The electroluminescent display device according to claim 6, wherein the representative value of the second distribution data includes at least one of a sum of counts for predesignated higher data intervals, a maximum value among real-time compensation values corresponding to counts of 1 or more, an average of the real-time compensation values corresponding to counts of 1 or more, a mode of the real-time compensation values corresponding to counts of 1 or more, and a median of the real-time compensation values corresponding to counts or 1 or more.

8. The electroluminescent display device according to claim 6, wherein the distribution calculator provides a preset negative offset to the second compensation value calculator in the operation power off periods when the total compensation value exceeds a preset compensation threshold value, and the second compensation value calculator additionally reflects the negative offset in the second compensation value.

9. The electroluminescent display device according to claim 6, wherein, when the total compensation value exceeds a preset compensation threshold value, the distribution calculator increases a first voltage allocation range for the total compensation value and reduces the total compensation value within a predetermined gamma output permission range.

10. The electroluminescent display device according to claim 9, wherein the distribution calculator increases the first voltage allocation range through data interval shift for the histogrammed second distribution data.

11. The electroluminescent display device according to claim 9, wherein a second voltage allocation range for a data voltage corresponding to the video data is reduced by increase in the first voltage allocation range within the gamma output permission range.

12. The electroluminescent display device according to claim 9, wherein a level of a reference voltage necessary to drive the pixels decreases by reduction in the total compensation value.

13. A method for driving an electroluminescent display device, comprising:

calculating a first compensation value based on prediction according to an accumulation result of video data to be written in pixels;

calculating a second compensation value based on sensing according to an electrical sensing value with respect to driving characteristics of the pixels; and correcting the video data on the basis of the first compensation value and the second compensation value, wherein video data of the pixels is accumulated in all power on periods and the driving characteristics of the pixels are sensed only in operation power off periods that are part of power off periods when a power on period and a power off period are alternately repeated, and wherein a time interval between two neighboring operation power off periods varies according to grayscales of the video data.

14. The method according to claim 13, wherein the first compensation value is initialized to "0" in the operation power off periods.

15. The method according to claim 13, wherein the time interval between two neighboring operation power off periods is shorter when a high-luminance image is displayed on a display panel with the pixels than when a low-luminance image is displayed on the display panel.

* * * * *